US012606412B2

(12) United States Patent
Pollock

(10) Patent No.: US 12,606,412 B2
(45) Date of Patent: Apr. 21, 2026

(54) OXYGEN TUBING RETRACTION AND STORAGE APPARATUS

(71) Applicant: Austin Pollock, Lowell, MI (US)

(72) Inventor: Austin Pollock, Lowell, MI (US)

(73) Assignee: Reel Free Corporation, Grand Rapids, MI (US)

( * ) Notice: Subject to any disclaimer, the term of this patent is extended or adjusted under 35 U.S.C. 154(b) by 184 days.

(21) Appl. No.: 18/389,150

(22) Filed: Nov. 13, 2023

(65) Prior Publication Data

US 2024/0158201 A1 May 16, 2024

Related U.S. Application Data

(60) Provisional application No. 63/525,580, filed on Jul. 7, 2023, provisional application No. 63/424,256, filed on Nov. 10, 2022.

(51) Int. Cl.
*B65H 75/44* (2006.01)

(52) U.S. Cl.
CPC ..... *B65H 75/4478* (2013.01); *B65H 75/4402* (2013.01); *B65H 75/4463* (2013.01); *B65H 75/4484* (2013.01); *B65H 75/4486* (2013.01); *B65H 2701/33* (2013.01)

(58) Field of Classification Search
CPC ..... B65H 75/44; B65H 75/4402; B65H 75/4463; B65H 75/4478; B65H 75/4484; B65H 75/4486; B65H 75/4415
See application file for complete search history.

(56) References Cited

U.S. PATENT DOCUMENTS

| | | | | |
|---|---|---|---|---|
| 8,727,084 | B1 * | 5/2014 | Kuker | B65H 75/425 242/378.2 |
| 2010/0307496 | A1 * | 12/2010 | Lueckenhoff | B65H 75/4471 242/388 |
| 2012/0227815 | A1 * | 9/2012 | Zink | B65H 75/4415 137/355.2 |
| 2016/0060075 | A1 * | 3/2016 | Slowik | A61M 16/0875 242/390.2 |
| 2022/0185620 | A1 * | 6/2022 | Abele | B65H 75/446 |

* cited by examiner

*Primary Examiner* — Sang K Kim
(74) *Attorney, Agent, or Firm* — The Watson IP Group; Jovan N. Jovanovic

(57) ABSTRACT

An oxygen tubing retraction and storage apparatus that provides for retraction of tubing that is between a patient and, for example, an oxygen machine. The retraction apparatus having a frame member, a drum assembly, a tube drum guide assembly and a motor assembly. The drum assembly rotates relative to the frame member, with the tube drum guide assembly cooperatively guiding tubing into and out of a channel on the drum assembly.

17 Claims, 13 Drawing Sheets

OXYGEN TUBING RETRACTION AND STORAGE APPARATUS

CROSS-REFERENCE TO RELATED APPLICATION

This application claims priority from U.S. Provisional Patent Application Ser. No. 63/424,256 filed on Nov. 10, 2022, entitled "OXYGEN TUBING RETRACTION AND STORAGE APPARATUS", and claims priority from U.S. Provisional Patent Application Ser. No. 63/525,580 filed on Jul. 7, 2023, entitled "OXYGEN TUBING RETRACTION AND STORAGE APPARATUS", the entire disclosures of which are hereby incorporated by reference in its entirety.

BACKGROUND OF THE DISCLOSURE

1. Field of the Disclosure

The disclosure relates in general to medical devices, and more particularly, to an oxygen tubing retraction and storage apparatus configured to controllably manage oxygen tubing that may be extend between a patient and an oxygen machine.

2. Background Art

Patients with various conditions (such as certain lung diseases, COPD, or other conditions) may require extra oxygen in order to lead a functional life. Some solutions to provide such extra oxygen are oxygen machines (often called an oxygen concentrator) which can provide supplemental oxygen (or air with a higher oxygen concentration). In many instances, patients can be in their home, active, but connected to such a machine.

Problematically, as the patient moves about a home toward and away from the oxygen machine, the tubing can become kinked, tangled and/or otherwise compromised. This can lead to damage to the tubing, damage to the oxygen machine, or worse, disruption of supplemental oxygen to the patient.

SUMMARY OF THE DISCLOSURE

The disclosure is directed to an oxygen tubing retraction and storage apparatus comprising a drum assembly, a frame, a tube drum guide assembly, and a motor assembly. The drum assembly may comprise a cylindrical member extending from a first end to a second end, the cylindrical member defining a longitudinal axis of rotation therethrough, the drum assembly may further comprise a first end drum support proximate to the first end and a second end drum support proximate to the second end, wherein the cylindrical member has an outer surface having a helical channel defined thereacross, the helical channel structurally configured to receive a length of tubing disposed therewithin. The frame may comprise a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame. The tube drum guide assembly may comprise an elongated guide member extending from a first end coupled to the first end drum support to a second end coupled to the second end drum support, and a slidable director structurally configured to be freely slidable between the first and second ends of the elongated guide member. The motor assembly may comprise a motor and motor axle, the motor assembly structurally configured to rotate the cylindrical member along the longitudinal axis.

In some configurations, the apparatus may further comprise a length of tubing, the tubing having a cross-sectional area sized to be disposed within the helical channel of the drum assembly.

In some configurations, the apparatus may further comprise an electronic remote controller to operate the motor assembly.

In some configurations, the first end drum mount and second end drum mount may be coupled to a base positioned below the drum assembly.

In some configurations, the base may be a lazy Susan, the lazy Susan being structurally configured to allow the apparatus to rotate about a vertical axis.

In some configurations, the apparatus may further comprise a tube frame guide assembly extending upward from the base and having a body and an opening extending through the body.

In some configurations, the cylindrical member of the apparatus may define a drum cavity.

In some configurations, the motor assembly may be positioned within a motor cavity, the motor cavity disposed within the second end drum mount.

In some configurations, the motor axle may extend through the second end drum mount to contact the second end drum support.

In some configurations, the slidable director may comprise a tubing guide channel.

In some configurations, the slidable director may comprise a wheeled guide structurally configured to travel along a ridge of the helical channel.

In some configurations, the slidable director may comprise a notch guide structurally configured to slidably interface with the helical channel.

In some configurations, the apparatus may further comprise a switch positioned at the second end of the elongated guide member of the tube drum guide assembly, the switch being in electronic communication with the motor.

In some configurations, the apparatus may be configured to be statically mounted.

In some configurations, the apparatus may further comprise an oxygen supply connector extending through the first end drum mount and first end drum support.

In another aspect of the disclosure, the disclosure is directed to a system comprising the apparatus and further comprising an oxygen machine.

In another aspect of the disclosure, the disclosure is directed to a method of using an oxygen tubing retraction and storage apparatus comprising the steps of: attaching a first end of a length of tubing to an oxygen supplying machine; providing the oxygen tubing retraction and storage apparatus comprising a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin, the apparatus further comprising a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame, and further comprising a tube drum guide assembly comprising an elongated guide member extending from a first end coupled to the first end drum support to a second end coupled to the second end drum support, and a slidable director structurally configured to be freely slidable between the first and second ends of the elongated guide member, and a motor assembly comprised of a motor and motor axle, the motor assembly structurally configured to rotate the cylindrical member along the longitudinal axis; disposing a portion of the length of tubing in the helical channel of the cylindrical member of the drum assembly; positioning a second end of the length of tubing proximate to the patient; unrolling a portion of the length of tubing from the drum assembly by pulling on the second end of the length of tubing; and activating the motor assembly to retract a portion of length the tubing back into the helical channel of the cylindrical member of the drum assembly.

In some configurations, the method may further comprise the use of a remote controller to activate the motor assembly.

BRIEF DESCRIPTION OF THE DRAWINGS

The disclosure will now be described with reference to the drawings wherein.

DETAILED DESCRIPTION OF THE DISCLOSURE

Figure 1:
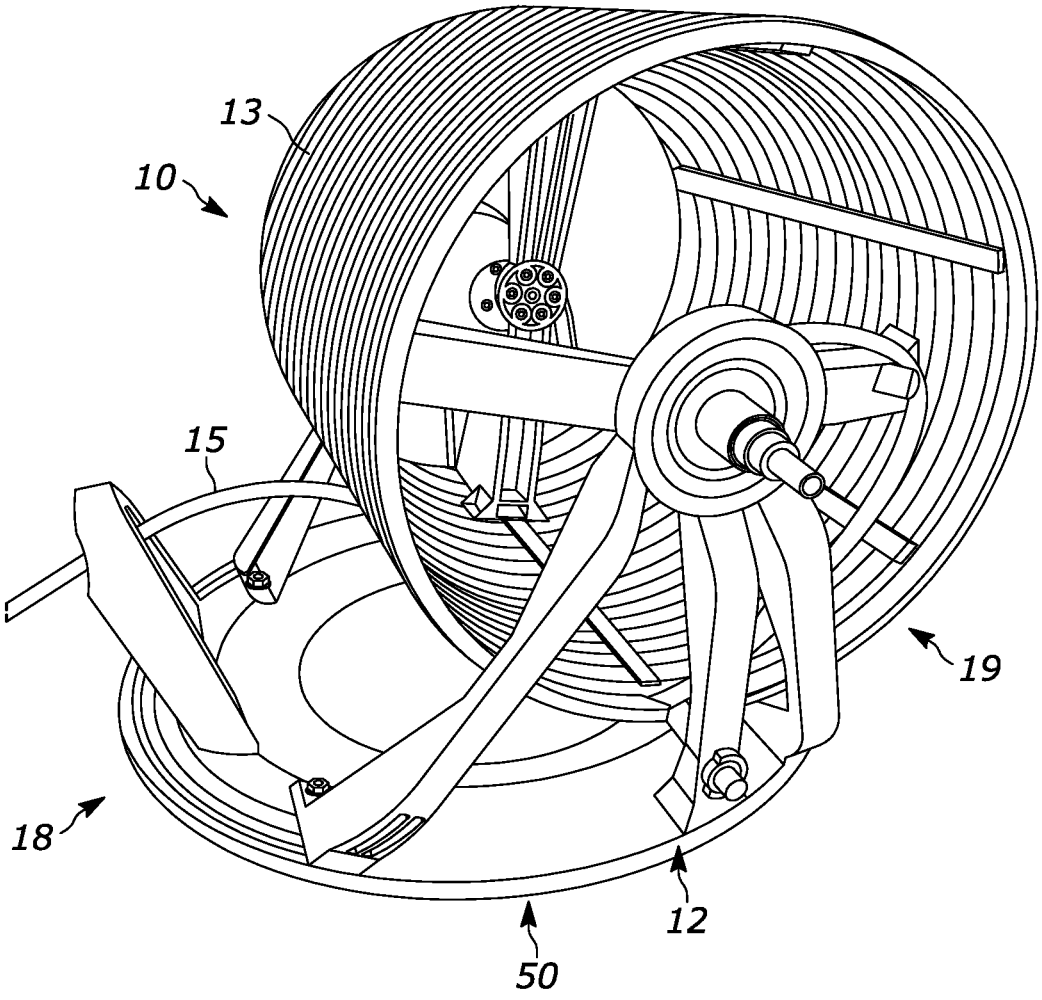
FIG. 1 of the drawings is a perspective view of the retraction apparatus, showing the tubing fulling retracted onto the drum assembly.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 14:
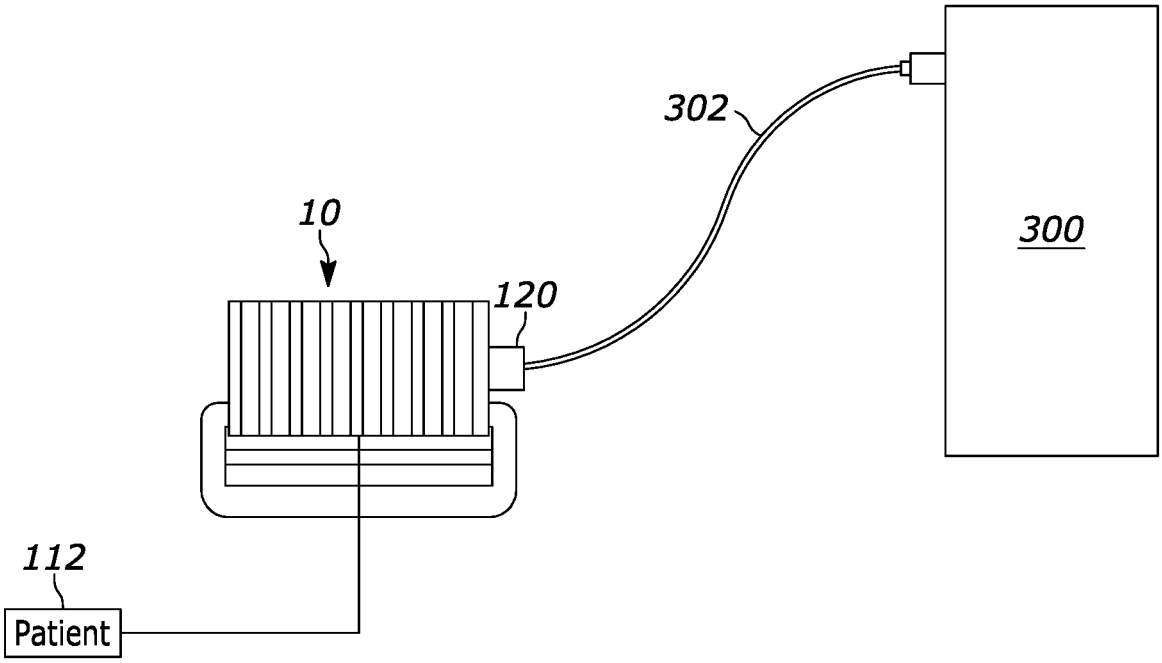
FIG. 14 of the drawings is a schematic representation of the retraction apparatus.

Referring now to the drawings and in particular FIG. 1, the oxygen tubing retraction and storage apparatus (hereinafter "retraction apparatus") is shown generally at 10. The retraction apparatus is configured for use with tubing 15 which is of the type generally utilized in the medical environment for delivering oxygen from an oxygen machine, such as oxygen machine 300 to a patient (FIG. 14). As will be understood, such an apparatus facilitates the management of such tubing which can often become tangled, kinked or otherwise degraded in operation, or, which can be damaged if not properly managed.

The retraction apparatus 10 includes frame member 12, drum assembly 13, tube drum guide assembly 14, motor assembly 16 and controller 17. The retraction apparatus 10 further having a front side 18, which corresponds to the side of the apparatus from which oxygen tubing is extended and retracted, and back side 19 opposite to the front side of the apparatus. The retraction apparatus is sized so as to be able to receive approximately 50 feet of tubing 15, while it is contemplated that the retraction apparatus may be modified so as to receive between 10 feet and 100 feet of tubing, while, again, not being limited thereto.

The frame 12 is shown as comprising first end drum mount 20, second end drum mount 40, lazy Susan 50, and tube frame guide assembly 60. The pair of end drum mounts are spaced apart from each other on opposite ends of drum assembly 13 and suspend the drum assembly above the lazy Susan 50, the lazy Susan functioning as a platform or base to frame 21 while providing rotational mobility, as will be described below in greater detail. The first and second end drum mounts are generally parallel to each other, extending upward from the lazy Susan 50, though they may be oblique to each other as well.

Figure 2:
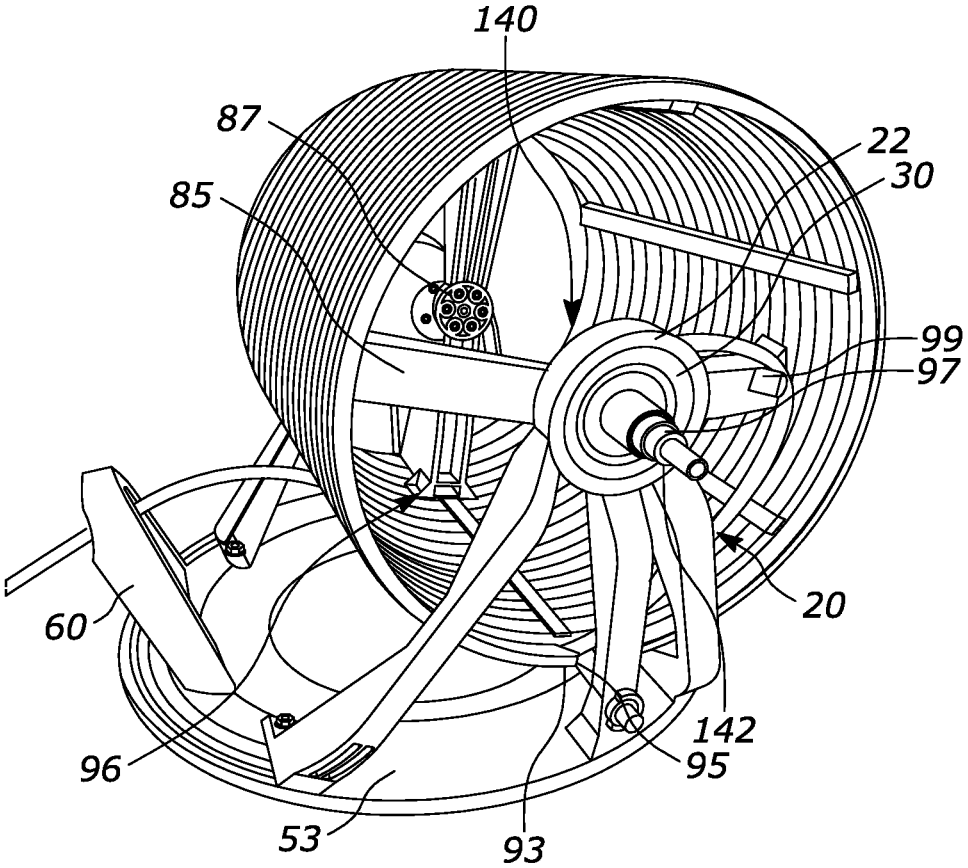
FIG. 2 of the drawings is a perspective view of the retraction apparatus, showing particularly the first side of the apparatus.

As shown in FIG. 2, the first end drum mount 20 includes an inner side 28 and outer side 29 opposite the inner side 28. The first end drum mount 20 further comprises a bearing mount section 22, first strut 24, second strut 25, and middle strut 26. The first, second, and middle struts extend generally downward from the bearing mount section 22 and couple to a first side 58 of the lazy Susan 50. The first strut 24 extends generally downward and toward the front side 18 of frame 12, while the second strut 25 extends generally downward and toward the back side 19 of frame 12, with the middle strut 26 extending downward and generally orthogonal to the bearing mount section 22 and the lazy Susan 50. While a three-strut embodiment is shown, it is contemplated that the first end drum mount 20 may have fewer or more struts to support the bearing mount section 22. The struts of the first end drum mount 20 may be coupled to the lazy Susan 50 and bearing mount section 22 through threaded, adhesive, or other coupling means, or in other embodiments these components may be integrally molded, for example out of a polymer material.

Bearing mount section 22 of the first end drum mount 20 is positioned above the first side 58 of the lazy Susan 50 and supported by the first, second, and middle struts. In the embodiment shown, the bearing mount section 22, the first side 58 of the lazy Susan 50, and the first, second, and middle struts 24, 25, 26 of the first end drum mount are generally coplanar, while variations are contemplated. The bearing mount section 22 defines a circular bearing cavity 23 extending through the body of the bearing mount section, from the inner side 28 to the outer side 29. The cavity 23 supports or otherwise mounts at least one bearing 30 or other rotative element which will couple with the drum 13, as further discussed below, and allow the assembly 13 to rotate about a central axis 98 of the drum assembly 13.

Figure 3:
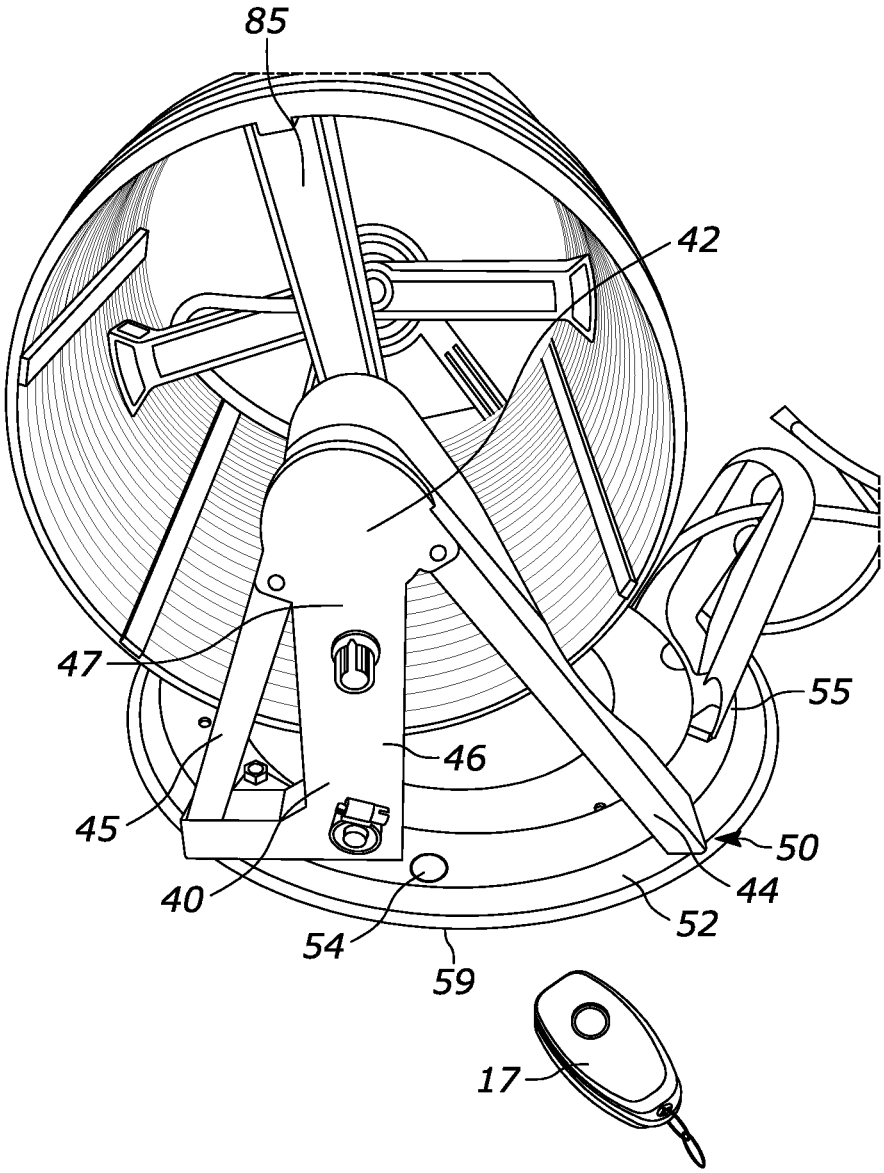
FIG. 3 of the drawings is a perspective view of the retraction apparatus and remote controller therefore, and showing particularly the second side of the apparatus.
Figure 4:
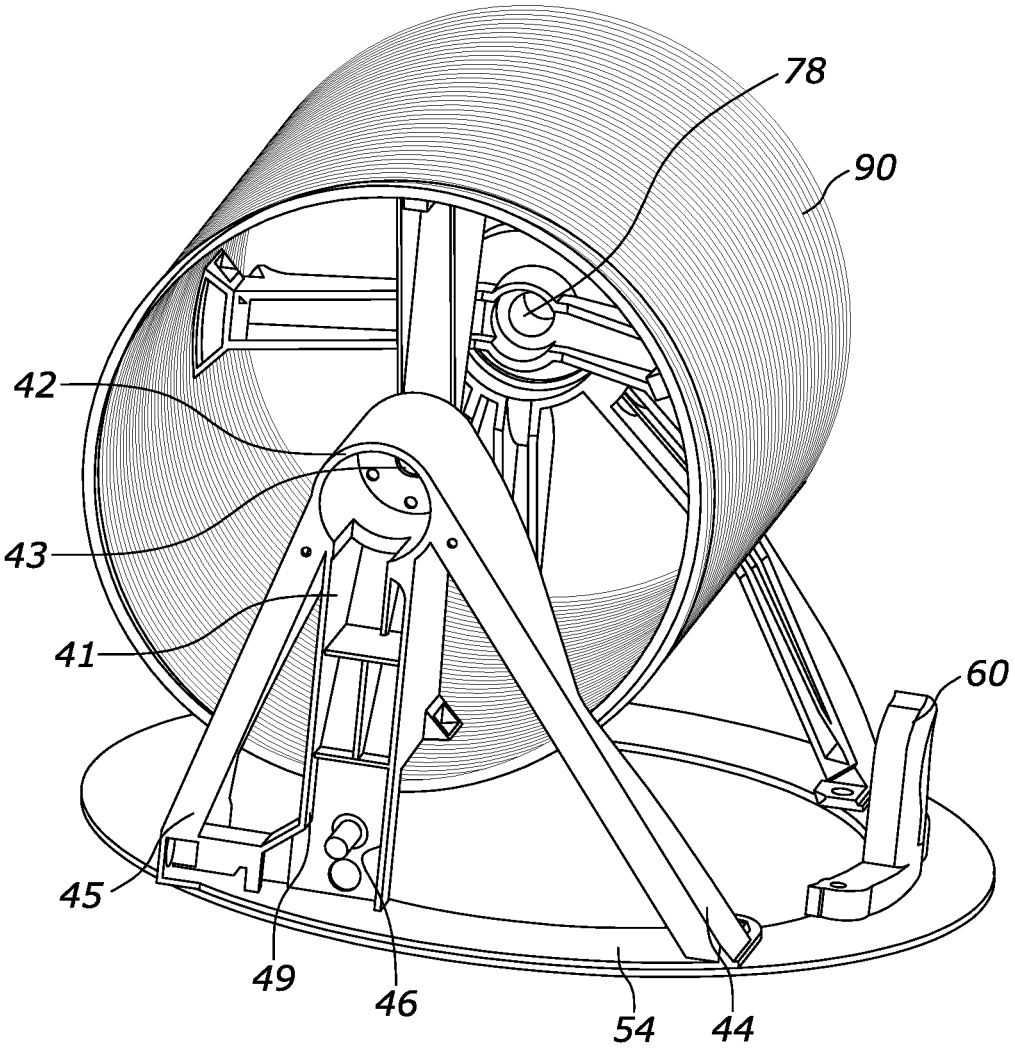
FIG. 4 of the drawings is a perspective view of the retraction apparatus.
Figure 5:
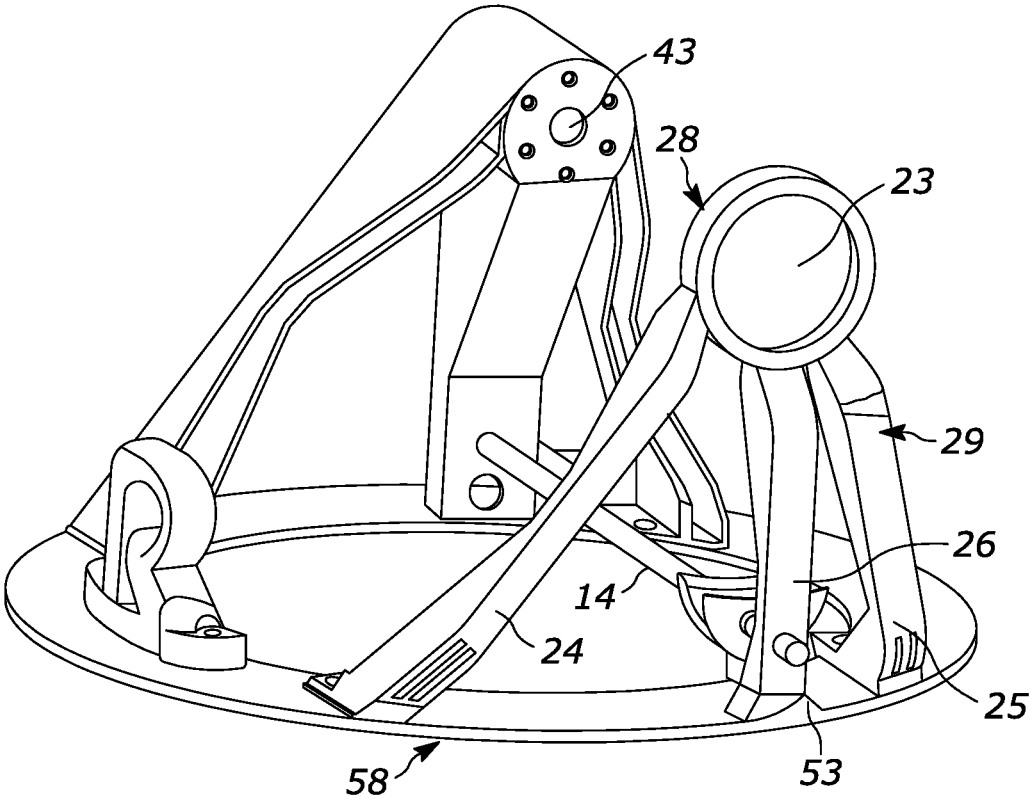
FIG. 5 of the drawings is a perspective view of the frame apparatus of the retraction apparatus.

The second end drum mount 40, best shown in FIG. 3, includes an inner side 48 and outer side 49 opposite the inner side 48. The second end drum mount further comprises a motor mount section 42, a first strut 44, second strut 45, and middle strut 46. The first, second, and middle struts extend generally downward from the motor mount section 42 and couple to a second side 59 of the lazy Susan 50. The first strut 44 extends generally downward and toward the front side 18 of frame 12, while the second strut 45 extends generally downward and toward the back side 19 of frame 12, with the middle strut 46 extending downward and generally orthogonal to the motor mount section 42 and the lazy Susan 50. While a three-strut embodiment is shown, it is contemplated that the second end drum mount 40 may have fewer or more struts to support the motor mount section 42. The struts of the second end drum mount 40 may be coupled to the lazy Susan 50 and motor mount section 22 through threaded, adhesive, or other coupling means, or in other embodiments these components may be integrally molded, for example out of a polymer material.

In the embodiment shown, motor mount section 42 of the second end drum mount 40 is positioned above the second side 59 of the lazy Susan 50 and supported by the first, second, and middle struts. In some embodiments, the motor mount section 42, the second side 59 of the lazy Susan 50, and the first, second, and middle struts 44, 45, 46 of the second end drum mount are generally coplanar, while variations are contemplated. Further the middle strut 46 and/or motor mount section 42 of the second end drum mount 40 define a motor cavity 41 which allows a motor of the motor assembly 16 to be housed within the motor mount section 42, as such, the inner side 48 of the second end drum mount may extend some distance into the drum cavity 96 of the drum assembly 13 to facilitate said motor cavity 41. It is also contemplated that the motor assembly 16 may be affixed or mounted to the apparatus 10 outside of the body of the second end drum mount 40. In the embodiment shown, the motor cavity 41 with its related motor, is covered by motor cover 47. The motor mount section 42 further comprises an axle cavity 43 which extends through the body of the motor mount section 42, such that an axle of the motor assembly 16 may extend through the motor mount section 42 and protrude from the inner side 48 thereof.

The lazy Susan 50 of frame 12 is comprised of a circular top plate 52 and bottom plate 56, with the top plate 52 further comprising a first strut portion 53 corresponding to the first side 58, a second strut portion 54 corresponding to the second side 59, and a tube guide portion 55 corresponding to the front side 18. The first end drum mount 20 and second end drum mount 40, along with their respective struts, are coupled to corresponding first strut portion 53 and second strut portion 54 of the top plate 52. This coupling may be accomplished by threaded, adhesive, or other fastening methods, or it is also contemplated that the components may be integrally molded. The tube frame guide assembly 60 is coupled to the tube guide portion 55 in a similar fashion.

The top plate 52 and bottom plate 56 are coupled together such that the top plate 52, along with the rest of frame 12, lays overtop of the bottom plate 56 and may rotatably slide overtop of the bottom plate, allowing the apparatus 10 to rotate or spin relative to the bottom plate. This allows the entire structure to rotate about a vertical axis as the tubing is being pulled out, retracted, or otherwise manipulated by a user. The apparatus rotates such that the tubing is being pulled out in a direction that minimizes bending, kinking, or otherwise damaging of the tubing. In some configurations, this slidable rotation may be accomplished by a rim and grove coupling between the top plate 52 and bottom plate 56, though alternate embodiments are contemplated. The current embodiment demonstrates a circular bottom plate 56, though it is also contemplated that the top plate may couple to alternative shape or mounts which may allow for a spinning rotation of the apparatus, while in other embodiments the first end drum mount 20 and second end drum mount 40 may be attached to a static or non-rotatable base or on a wall or fixture of a building or room.

Figure 11:
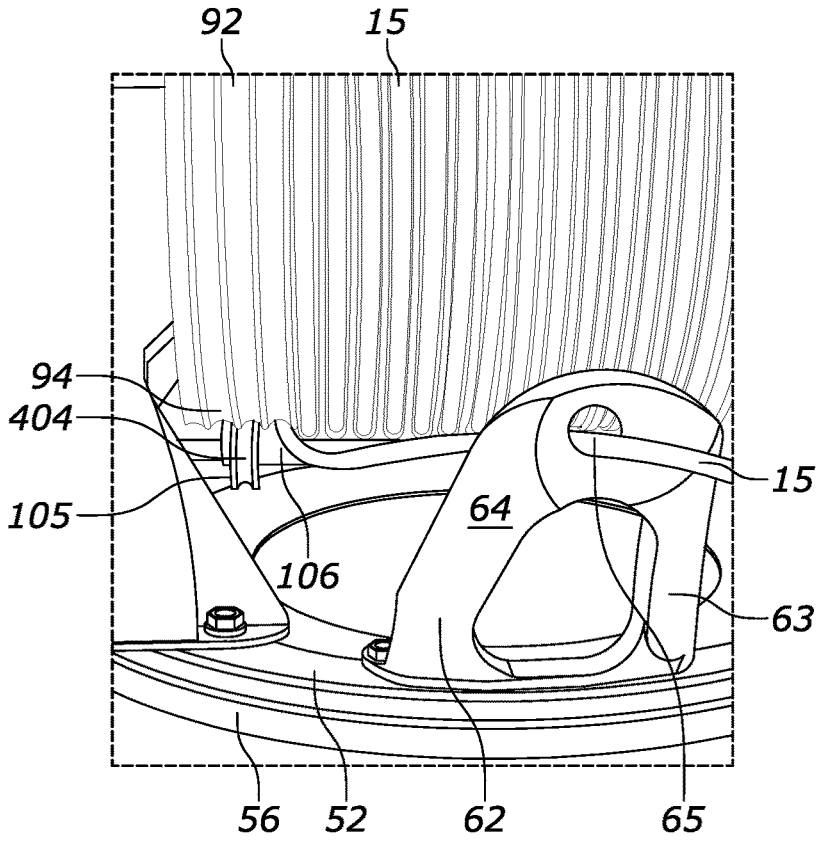
FIG. 11 of the drawings is a partial perspective view of the retraction apparatus.

The tube frame guide assembly 60 of frame 12, as shown in FIG. 11, comprises a first leg 62, second leg 63, body 64, and body opening 65. The first leg 62 and second leg 63 extend generally downward from the body 64 and couple the body to the tube guide portion 55 of the top plate 52. This coupling may be accomplished through threaded, adhesive, or other coupling methods, or all the components may be integrally formed. A body opening 65 extends through body 64 of the tube frame guide assembly such that tubing 15 may slidably pass through body 64. In the configuration shown, the tube frame guide assembly 60 is substantially coplanar with the tube guide portion 55 of the top plate, and is positioned substantially perpendicular to the central axis 98 of the drum assembly 13.

Figure 6:
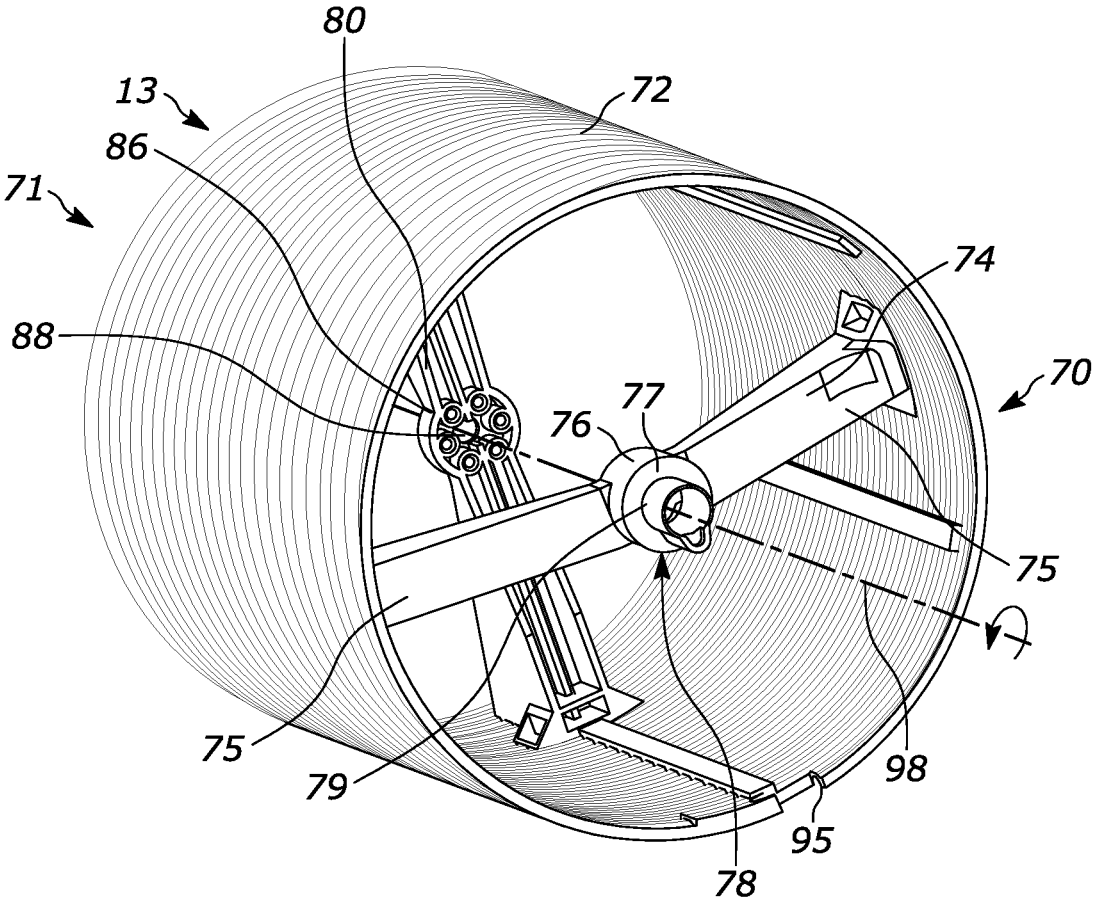
FIG. 6 of the drawings is a perspective view of the drum assembly of the retraction apparatus.
Figure 7:
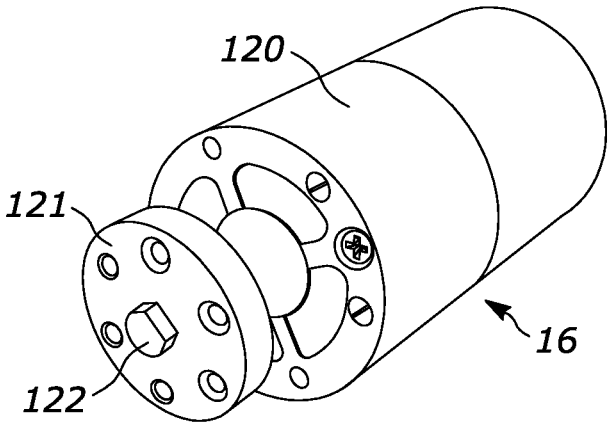
FIG. 7 of the drawings is a perspective view of the motor assembly of the retraction apparatus.
Figure 8:
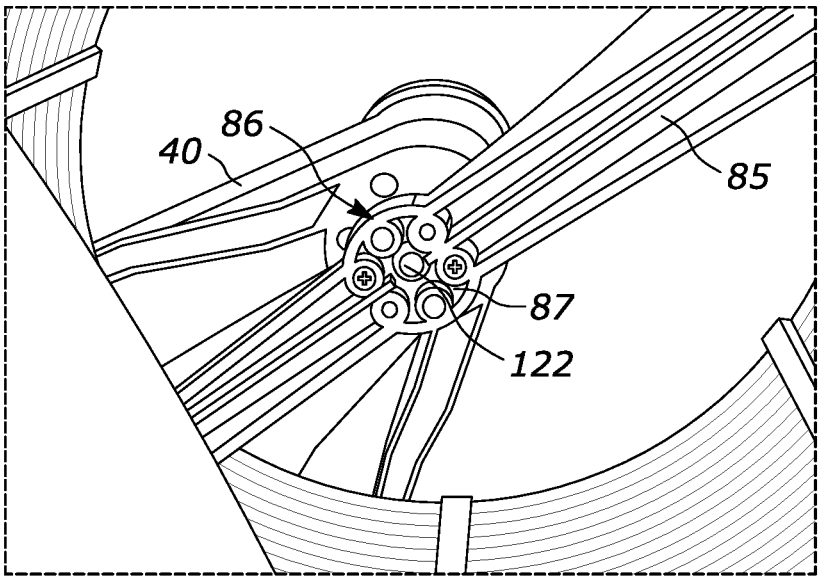
FIG. 8 of the drawings is a perspective view of the second end drum support of the retraction apparatus.
Figure 9:
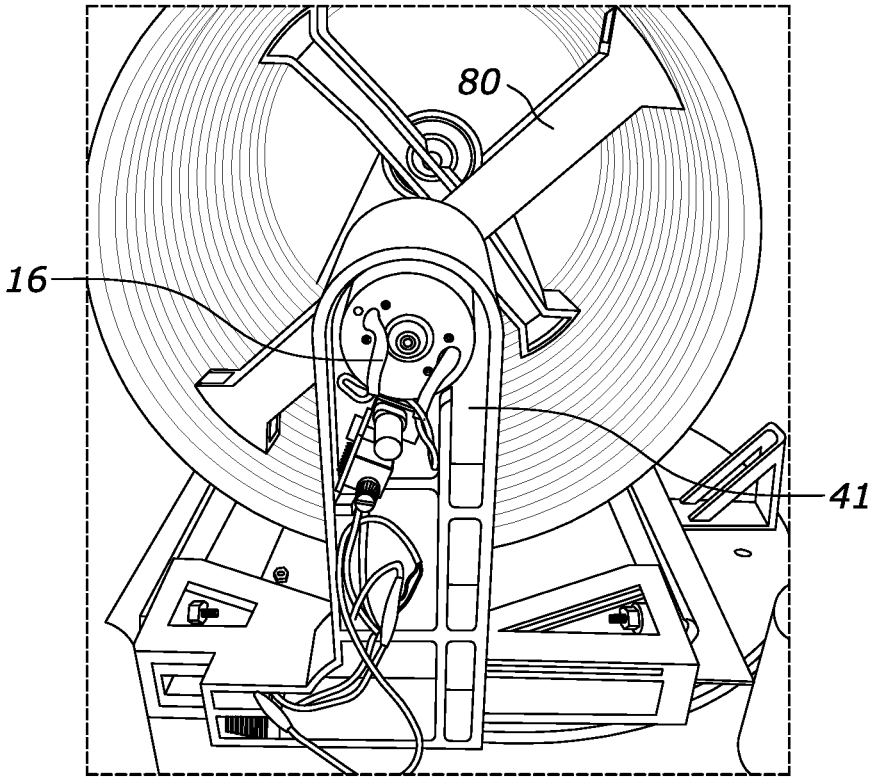
FIG. 9 of the drawings is end perspective view of the retraction apparatus; apparatus.

In looking now to FIG. 6, the drum assembly 13 is shown as including a first end 70 and second end 71. The drum assembly is defined by a cylindrical member 72, first end drum support 74, second end drum support 80, outer surface 90, and drum cavity 96. As will be explained, the drum assembly 13 is configured to rotate about an axis of rotation relative to the frame 12, that being central axis 98. In the configuration shown, the diameter of the cylindrical member 72 is substantially constant and defines drum cavity 96, though other configurations and surface variations are contemplated, including but not limited to a frustoconical configuration.

First end drum support 74, as shown in FIG. 6, comprises at least one arm member 75 coupled to a central hub 76. The arm members 75 are sized to position the central hub 76 roughly within the center of the drum cavity 96 toward the first end 70 of the drum assembly 13. The central hub 76 further comprises a cylindrical bearing mount 77 extending from the central hub 76, the bearing mount 77 defining a bearing mount surface 79 which is in contact with bearing 30 of the first end drum mount 20. The interface between bearing 30 and the bearing mounting surface 79 allows the drum assembly 13 to freely rotate, both clockwise and counterclockwise, around the central axis 98 during operation of the retraction apparatus 10. A tube opening 78 extends completely through the first end drum support 74 such that an oxygen supply connector 97 may be affixed to allow oxygen to flow from an oxygen machine 300 into the oxygen tubing 15 of the apparatus 10.

The second end drum support 80, comprises at least one arm member 85 coupled to a central hub 86, the central hub 86 being a coupling point between the second end drum support 80 and the second end drum mount 40 or motor assembly 16. The arm members 85 are sized to position the central hub 86 roughly within the center of the drum cavity 96, in-line with the central hub 76 of the first end drum support 74, and toward the second end 71 of the drum assembly 13, though alternate configurations and positioning of the hub 86, relative to the drum, are contemplated. In the configuration shown, the central hub 86 has a motor axle opening 88 and drum flange 87 capable of coupling the drum to the motor axle 122, such that when the motor axle 122 rotates the drum assembly 13 may correspondingly rotate. It is further contemplated that the central hub 86 may be coupled to the motor assembly 16 through alternate means, or the central hub 86 may be coupled to the second end drum mount 40 directly through use of a bearing or other rotative device, with a motor providing rotation through alternate coupling means.

Figure 15:
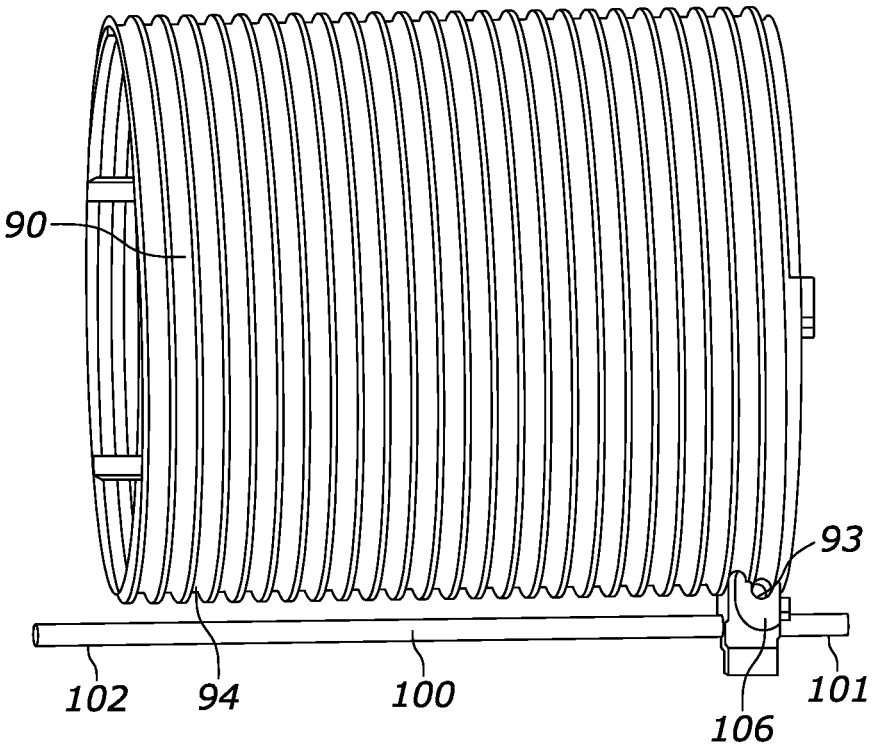
FIG. 15 of the drawings is perspective view of a portion of the retraction apparatus.

In looking to FIG. 15, the outer surface 90 of the cylindrical member 72, opposite the drum cavity 96, includes a helical channel 92 extending thereacross, the helical channel defines a first end 93 and a second end 94. In the configuration shown, the helical channel has a channel length of approximately 50 feet, with the understanding that the length of the helical channel length may be longer or shorter than 50 feet. The helical channel, proximate the first end 93 of the outer surface, includes a tube opening 95 extending through the outer surface and into the drum cavity, the opening 95 sized to receive or otherwise facilitate the passthrough of tubing 15, as shown in FIG. 2.

A tube drum guide assembly 14 is shown as comprising an elongated guide member 100 and slidable director 105. The elongated guide member 100 includes first end 101 and second end 102 and may be positioned on one side or below the cylindrical member 72 of the drum assembly 13. The elongated guide member as shown is positioned below the cylindrical member 72 and extends between the first end drum mount 20 and second end drum mount 40, coupling to each end drum mount respectively. In the configuration shown, the elongated guide member 100 is positioned so as to be generally parallel to the outer surface 90 of the cylindrical member and comprises a rod having a generally uniform cross-sectional configuration. The slidable director 105 includes a guide channel 106 defined therein, and the slidable director 105 is freely slidable between the first and second ends of the elongated guide member.

In another configuration, the tube drum guide assembly 14 may comprise a second elongated guide member and second slidable director positioned proximate to the front side 18 or back side 19 of the cylindrical member, with the first elongated guide member being positioned proximate to the front side 18, back side 19, or below the cylindrical member of the drum assembly.

Figure 16:
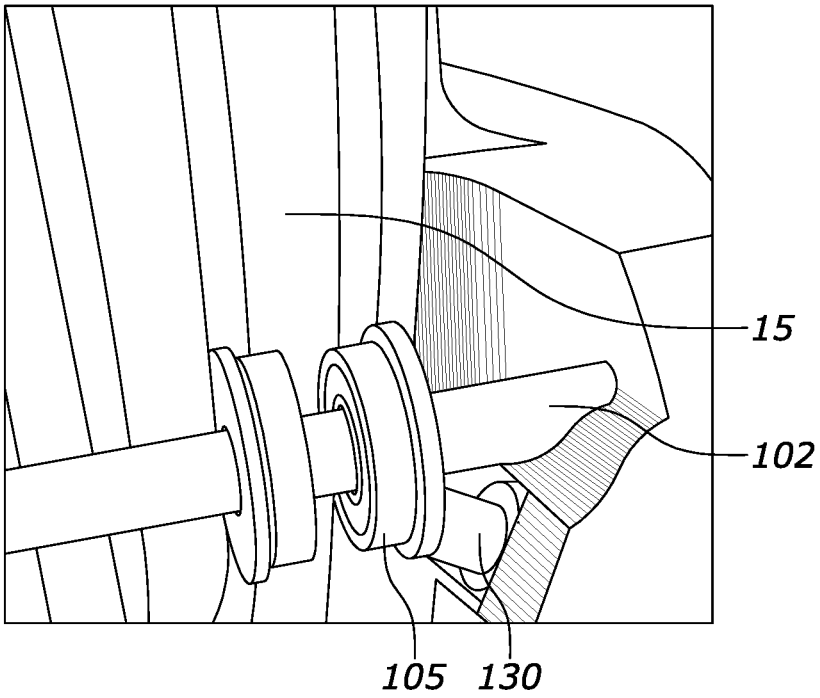
FIG. 16 of the drawings is perspective view of a portion of the retraction apparatus.

At a second end of one of the first and second elongated guide members, a switch 130 may be positioned. The switch is in electrical communication with controller 17 and/or motor assembly 16. The triggering of the switch is the result of the associated slidable director reaching the switch, and, essentially the end of travel, as shown in FIG. 16. As will be explained below, this evidences that the helical channel 80 has reached its capacity of tubing contained on the drum assembly.

It is contemplated that the drum assembly may comprise a frustoconical configuration in place of the cylindrical member, with elongated guide members being parallel to the outer surface of the configuration.

Figure 12:
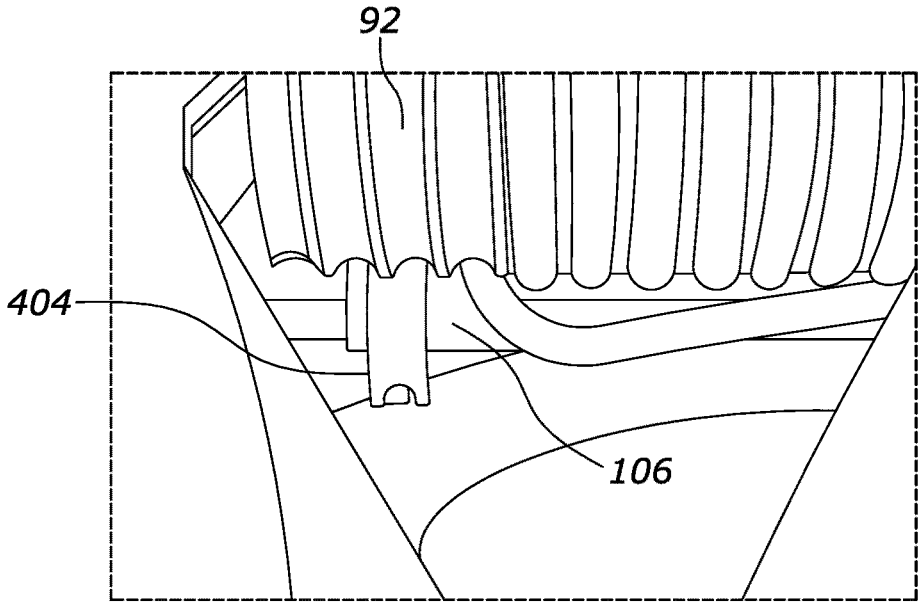
FIG. 12 of the drawings is a partial perspective view of the retraction apparatus.
Figure 13:
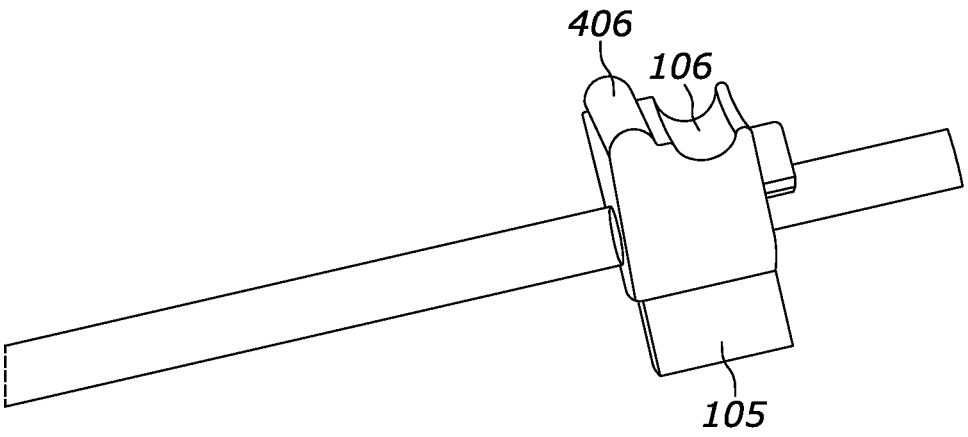
FIG. 13 of the drawings is a perspective view of the guide member and slidable director of the retraction apparatus.

FIGS. 11 and 12 show one configuration of slidable director 105. Such a configuration provides a guide channel 106 along which the tubing can be positioned within the helical channel 92. Additionally, the slidable director 105 includes a wheeled guide 404 that travels along the ridge created by the helical channel 92. It will be understood that as the cylindrical member 72 rotates, the wheel travels therealong, and, at the same time translates along the drum from one end to the other (depending on the rotation thereof). FIGS. 13 and 15 show another configuration of the slidable director 105 in which the director is guided by a notch guide 406 which is sized to fit within the helical channel 92 and provide alignment of the slidable director as the cylindrical member 72 rotates.

It is contemplated that this apparatus can be used in nursing homes, hospitals, or homes, and may be mounted on a wall or positioned and moveable on a floor or other surface. In such instances, the length of tubing may be modified so as to be shorter, while other variations are contemplated.

The motor assembly 16 is shown as comprising a motor 120, a motor axle 122 which is driven by the motor, and a motor flange 121 which is coupled to the end of the motor axle. In certain configurations, the axle 122 may comprise the output shaft of the motor. In other configurations, a transmission may be disposed between the motor output shaft and the axle 122. In such a configuration, a belt with pulleys, a gear train (i.e., straight gears, a worm gear combination, etc.) is likewise contemplated. The motor may comprise a servo motor, a conventional electrical motor, among other configurations. It will be understood that the motor may provide a direct drive, or, an indirect drive through a transmission. It is contemplated that the motor may spin freely when not powered or operating, thus allowing the drum assembly to freely rotate as the tubing is unrolled. It is further contemplated that in other embodiments the motor may not be allowed to freely spin.

Figure 10:
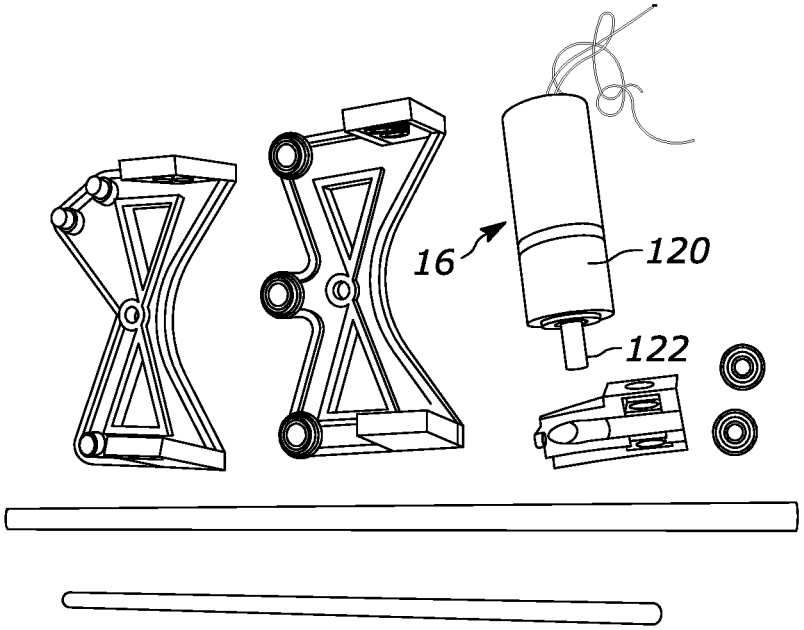
FIG. 10 of the drawings is an exploded view of components of the retraction apparatus.

The motor assembly 16 is configured to be housed within the motor cavity 41 of the motor mount section 42 of the second end drum mount 40. The motor assembly may be mounted within the motor cavity 41 by various means, including allowing the motor to rest upon a ledge or surface within the cavity, or be affixed, removable or otherwise, to the walls of the motor mount cavity. The motor assembly is positioned such that the motor axle 122 extends through the axle cavity 43 of the motor mount section and can be placed in contact or coupled with the central hub 86 of the second end drum support 80. In the configuration shown, a motor flange 121 is affixed proximate to the end of axle 122 and couples to a drum flange 87 of the central hub of the second end drum support 80. In some configurations, the motor axle 122 may extend entirely through the axle cavity 43 of the second end drum mount 40, then extend entirely through the motor flange 121 and drum flange 87, and further extend into a motor axle opening 88 of the second end drum support 80, as shown in FIG. 10.

The motor controller 17 may comprise multiple components. For example, the motor controller may comprise circuitry which is electrically in communication with the motor 120, and which can direct the motor 120 to rotate as desired. Additionally, a separate controller (which may be wired or wireless) can be distally positionable relative to the motor 120 and provides for a user to transmit commands to the controller and to the motor 120 so as to achieve a desired action by the motor 120. A number of different configurations are contemplated of wired and wireless controllers which may be dedicated controllers. It is also contemplated that communication with a phone, tablet or the like may be enabled through, for example Bluetooth, Wi-Fi, or other communication protocol so that a patient or caregiver can operate the motor through his or her phone, for example.

Figure 17:
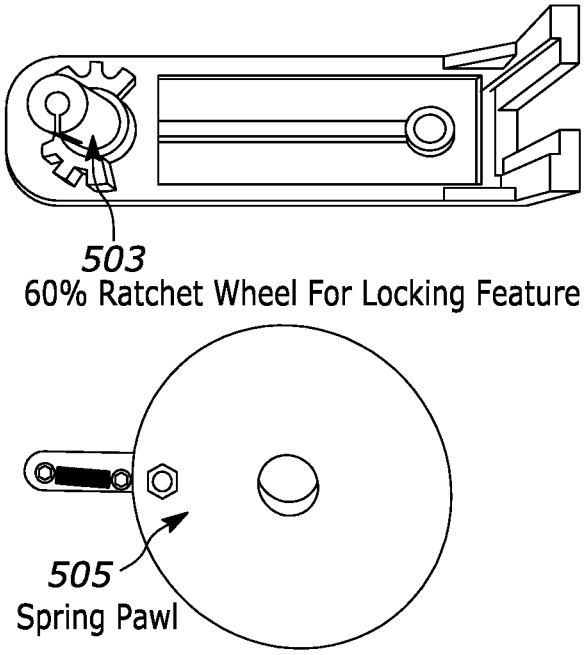
FIG. 17 of the drawings is side elevational view of a portion of an alternate retraction system.
Figure 18:
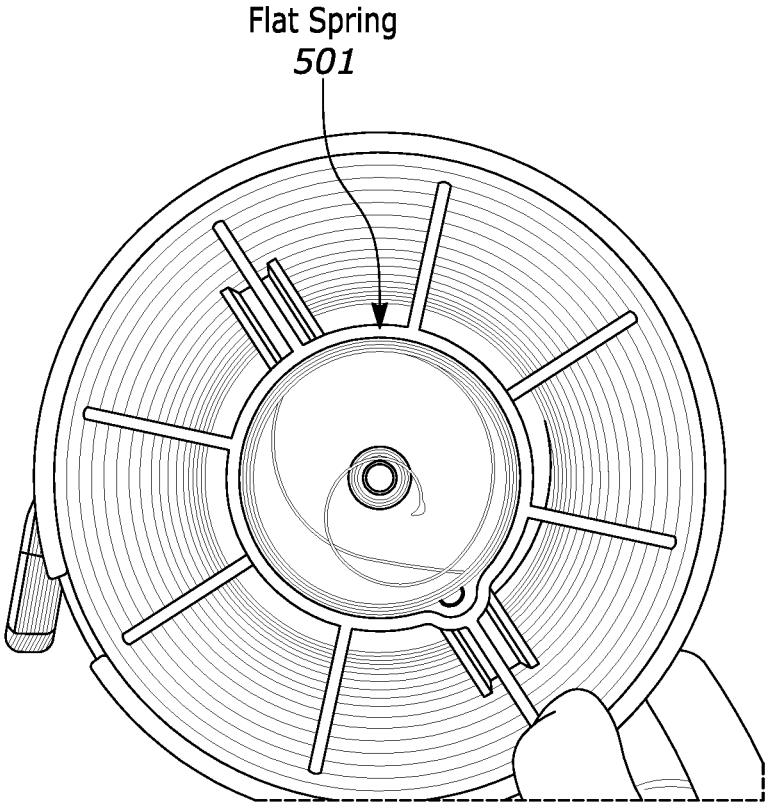
FIG. 18 of the drawings is a side elevational view of a portion of an alternate retraction system.
Figure 19:
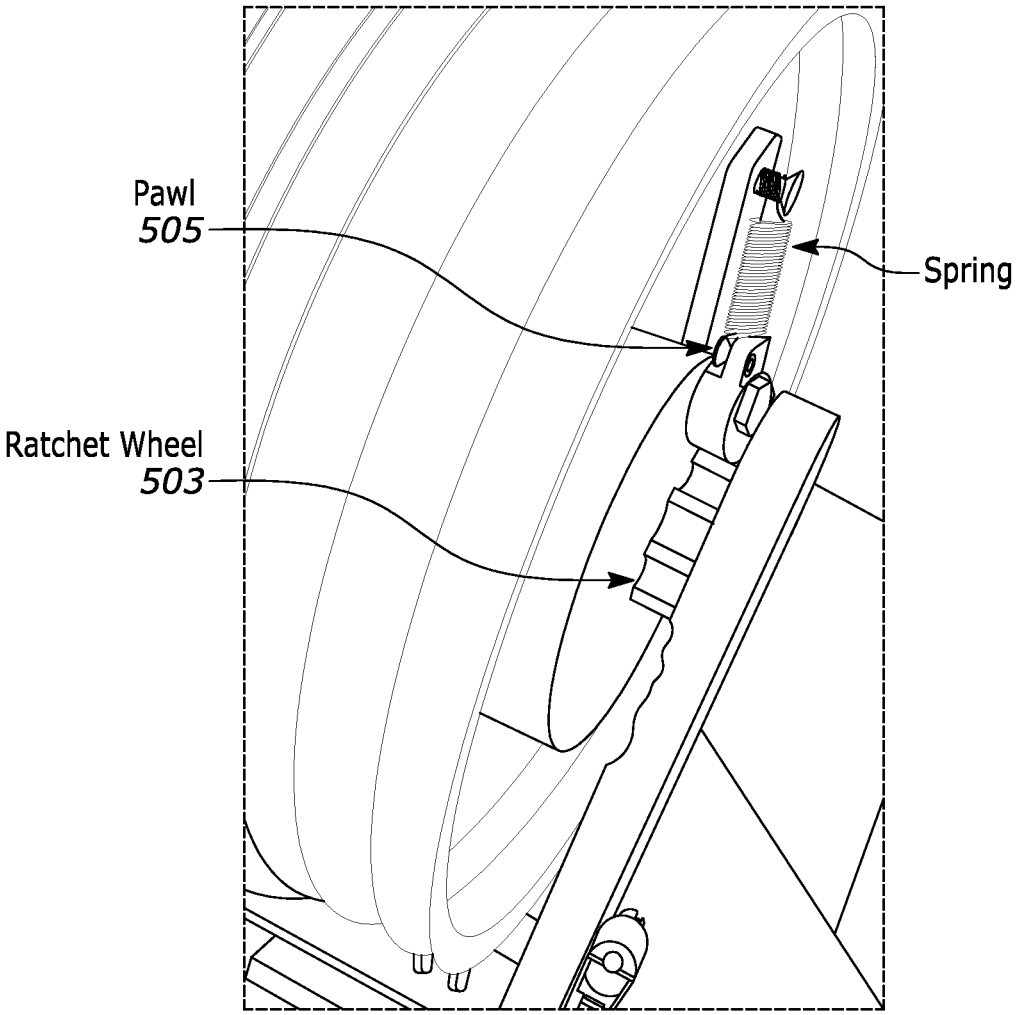
FIG. 19 of the drawings is a partial side elevational view of a portion of an alternate retraction system.

In another configuration, as is shown in FIGS. 17 through 19, instead of an electric motor, the system may comprise a manually operated system wherein the retraction power is stored in a flat spring 501 which can be energized when the tubing is pulled. In such a configuration, the rotation of the drum can be managed and controlled by a ratchet wheel 503 that rotates with the drum and a pawl spring 505 mechanism which can interface with the ratchet wheel to selectively permit and preclude rotation of the drum relative to the frame. While unique to the present application, such retraction systems can be observed in use with extension cords, among other devices.

The tubing 15 is shown as comprising a first end 110 which is coupled to the cavity side 140 of the oxygen supply connector 97, a separate portion of machine tubing 302 couples the outer side 142 of the oxygen supply connector 97 to an oxygen machine 300. A second end 112 of the tubing 15 which defines an exhaust (directly or indirectly through attachment to a separate component) is positioned proximate the nose and/or mouth of the patient. In some configurations, the tubing may extend directly through tube opening 78 of the first end drum support 74 and couple directly with the oxygen machine 300.

In the configuration shown, the first end 110 of the tubing is connected to the cavity side of the oxygen supply connector 97. From there, the tubing is redirected by a tube hook 99 affixed to one of the arm members 75 of the first end drum support 74. The tube is redirected to extend through the tube opening 95 of the drum assembly outer surface 90 and can be disposed in the helical channel 92 of the outer surface of the cylindrical member 72. At the same time, the tubing extends through guide channel 106 of the slidable director 105. Prior to the second end 112 being positioned proximate to the patient, it extends through the body opening 65 of the tube frame guide assembly 60. This allows for the tube to maintain a certain amount of alignment while being disposed into the helical channel 92 during extension and retraction of the tubing 15, thus preventing kinking, snagging, or misplacement of the tubing during within the apparatus.

In operation, the caregiver first provides a source of oxygen, such as an oxygen machine 300. Machine tubing 302 is coupled to the outlet of the oxygen machine 300 at one end and to the outer side 142 of the oxygen supply connector 97 of the drum assembly 13. Similarly, the second end 112 of the tubing 15 is positioned in the desired orientation on the patient so that oxygen from the oxygen machine can be directed to the nose and/or mouth of the patient.

Initially, the tubing 15 is in a position such that it is placed in substantially the entirety of the helical channel 92 of the drum assembly outer surface 90. As the patient moves about and, for example, moves away from the retracting apparatus, the tubing is pulled by the patient. Such pulling of the tubing results in the unrolling of the tubing from the helical channel of the drum assembly. It will be understood that as this continues, the drum assembly is rotated relative to the frame member 12. The interface between the helical channel 92, the tubing 15 and the slidable director 105 maintain the tubing within the channel until it is unrolled therefrom. The passing of the tubing through tube frame guide assembly 60 further assists in an orderly unrolling of the tubing. As the tubing unrolls, the cooperation of the tubing, the helical channel and the slidable directors linearly moves the slidable director 105 along the elongated guide member 100.

It will be understood that the drum assembly can freely rotate relative to the frame, or may be assisted by the motor operating in a first rotational direction. Once the patient has returned (or, otherwise, there is slack in the tubing), it may be desirable to return the tubing onto the drum assembly. In such an event, the patient and/or the caregiver can actuate the motor to operate in a direction to wind up the tubing. As the drum assembly is rotated the tubing is directed into the helical channel through cooperative engagement of the tubing with the helical channel and the first and second slidable directors slidably moving along the respective elongated guide members. Continued rotation of the drum assembly continues to wind up the tubing. If the motor encounters an increased power draw, for example, this may be an indication that the tubing is bound or snagged. In such a condition, the controller may sense such a condition and stop the rotation. Similarly, as the switch 130 is triggered by the respective one of the slidable directors, the motor can be stopped (as the end of travel for the slidable director has been reached, meaning that the helical channel has been filled by the tubing). It will further be understood that the retraction and/or extension can be variable in speed for different walking/moving speeds of patients.

The foregoing can be repeatedly actuated so as to unwind or rewind the tubing in and out of the drum assembly.

It will be understood that the motor assembly and the controller may be powered through a power adapter, and the retracting apparatus may be positioned on the floor or on another surface. In other configurations, the motor assembly and the controller may be battery operated so that the retracting apparatus is portable and so that it can travel with the user and with the oxygen machine. Additionally, the drum assembly can be scaled so that it can accommodate a greater amount of tubing or a smaller amount of tubing (i.e., for portability). Among other variations, the length of the drum assembly as well as the diameter can be modified so as to accommodate different environments.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. An oxygen tubing retraction and storage apparatus comprising:

a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin;

a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame;

a tube drum guide assembly comprising an elongated guide member extending from a first end coupled to the first end drum support to a second end coupled to the second end drum support, and a slidable director structurally configured to be freely slidable between the first and second ends of the elongated guide member, and, wherein the slidable director comprises a notch guide structurally configured to slidably interface with the helical channel; and a motor assembly comprised of a motor and motor axle, the motor assembly structurally configured to rotate the cylindrical member along the longitudinal axis.

2. The apparatus of claim 1 further comprising a length of tubing, the tubing having a cross-sectional area sized to be disposed within the helical channel of the drum assembly.

3. The apparatus of claim 1 further comprising an electronic remote controller to operate the motor assembly.

4. The apparatus of claim 1, wherein the first end drum mount and second end drum mount are further coupled to a base positioned below the drum assembly.

5. The apparatus of claim 1, wherein the cylindrical member defines a drum cavity.

6. The apparatus of claim 1, wherein the motor assembly is positioned within a motor cavity, the motor cavity disposed within the second end drum mount.

7. The apparatus of claim 1, wherein the motor axle extends through the second end drum mount to contact the second end drum support.

8. The apparatus of claim 1, wherein the slidable director comprises a tubing guide channel.

9. The apparatus of claim 1, wherein the apparatus is configured to be statically mounted.

10. The apparatus of claim 1 further comprising an oxygen supply connector extending through the first end drum mount and first end drum support.

11. A system including the oxygen tubing retraction and storage apparatus according to claim 1, the system further comprising an oxygen machine.

12. An oxygen tubing retraction and storage apparatus comprising:

a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin;

a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame;

a tube drum guide assembly comprising an elongated guide member extending from a first end coupled to the first end drum support to a second end coupled to the second end drum support, and a slidable director structurally configured to be freely slidable between the first and second ends of the elongated guide member; and a motor assembly comprised of a motor and motor axle, the motor assembly structurally configured to rotate the cylindrical member along the longitudinal axis, wherein the first end drum mount and second end drum mount are further coupled to a base positioned below the drum assembly and, wherein the base is a lazy Susan, the lazy Susan being structurally configured to allow the apparatus to rotate about a vertical axis.

13. An oxygen tubing retraction and storage apparatus comprising:

a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin;

a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame;

a tube drum guide assembly comprising an elongated guide member extending from a first end coupled to the first end drum support to a second end coupled to the second end drum support, and a slidable director structurally configured to be freely slidable between the first and second ends of the elongated guide member; and a motor assembly comprised of a motor and motor axle, the motor assembly structurally configured to rotate the cylindrical member along the longitudinal axis;

wherein the first end drum mount and second end drum mount are further coupled to a base positioned below the drum assembly; and a tube frame guide assembly extending upward from the base and having a body and an opening extending through the body.

14. An oxygen tubing retraction and storage apparatus comprising:

a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin;

a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame;

a tube drum guide assembly comprising an elongated guide member extending from a first end coupled to the first end drum support to a second end coupled to the second end drum support, and a slidable director structurally configured to be freely slidable between the first and second ends of the elongated guide member, wherein the slidable director comprises a wheeled guide structurally configured to travel along a ridge of the helical channel; and a motor assembly comprised of a motor and motor axle, the motor assembly structurally configured to rotate the cylindrical member along the longitudinal axis.

15. An oxygen tubing retraction and storage apparatus comprising:

a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin;

a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame;

a tube drum guide assembly comprising an elongated guide member extending from a first end coupled to the first end drum support to a second end coupled to the second end drum support, and a slidable director structurally configured to be freely slidable between the first and second ends of the elongated guide member; and a motor assembly comprised of a motor and motor axle, the motor assembly structurally configured to rotate the cylindrical member along the longitudinal axis; and a switch positioned at the second end of the elongated guide member of the tube drum guide assembly, the switch being in electronic communication with the motor.

16. A method of using an oxygen tubing retraction and storage apparatus comprising the steps of:

attaching a first end of a length of tubing to an oxygen supplying machine;

providing the oxygen tubing retraction and storage apparatus comprising:

a drum assembly comprising a cylindrical member extending from a first end to a second end, the cylindrical member defining a longitudinal axis of rotation therethrough, the drum assembly further comprising a first end drum support proximate to the first end and a second end drum support proximate to the second end, wherein the cylindrical member has an outer surface having a helical channel defined thereacross, the helical channel structurally configured to receive a length of tubing disposed therewithin;

a frame comprising a first end drum mount and a second end drum mount, wherein the first end drum mount is coupled to the first end drum support and the second end drum mount is coupled to the second end drum support, the first end drum support having a bearing or other rotative element to allow for rotation of the drum, along the longitudinal axis of rotation, relative to the frame;

a tube drum guide assembly comprising an elongated guide member extending from a first end coupled to the first end drum support to a second end coupled to the second end drum support, and a slidable director structurally configured to be freely slidable between the first and second ends of the elongated guide member; and a motor assembly comprised of a motor and motor axle, the motor assembly structurally configured to rotate the cylindrical member along the longitudinal axis;

disposing a portion of the length of tubing in the helical channel of the cylindrical member of the drum assembly;

positioning a second end of the length of tubing proximate to the patient;

unrolling a portion of the length of tubing from the drum assembly by pulling on the second end of the length of tubing; and activating the motor assembly to retract a portion of length the tubing back into the helical channel of the cylindrical member of the drum assembly.

17. The method of claim 16, wherein the motor assembly is activated by a remote controller.

* * * * *